US006752116B2

(12) United States Patent
Gaessler et al.

(10) Patent No.: US 6,752,116 B2
(45) Date of Patent: Jun. 22, 2004

(54) CONNECTION BETWEEN TWO SHAFT ENDS, POSITIONED COAXIALLY ONE BEHIND THE OTHER, OF A GAS SHUTTLE VALVE IN AN INTERNAL COMBUSTION ENGINE AND A VALVE ACTUATOR

(75) Inventors: Hermann Gaessler, Vahingen (DE); Udo Diehl, Stuttgart (DE); Karsten Mischker, Leonberg (DE); Rainer Walter, Pleidelsheim (DE); Bernd Rosenau, Tamm (DE); Jürgen Schiemann, Markgroeningen (DE); Christian Grosse, Kornwestheim (DE); Georg Mallebrein, Korntal-Münchingen (DE); Volker Beuche, Stuttgart (DE); Stefan Reimer, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/089,499

(22) PCT Filed: Jul. 18, 2001

(86) PCT No.: PCT/DE01/02691

§ 371 (c)(1),
(2), (4) Date: Aug. 19, 2002

(87) PCT Pub. No.: WO02/10558

PCT Pub. Date: Feb. 7, 2002

(65) Prior Publication Data

US 2003/0029410 A1 Feb. 13, 2003

(30) Foreign Application Priority Data

Jul. 28, 2000 (DE) ..... 100 36 810

(51) Int. Cl.[7] ..... F02N 3/00

(52) U.S. Cl. ..... 123/188.3

(58) Field of Search ..... 123/188.3, 90.11, 123/90.12, 90.13, 90.14

(56) References Cited

FOREIGN PATENT DOCUMENTS

| | | | |
|---|---|---|---|
| DE | 198 11 779 | 4/1999 | |
| DE | 19811779 C1 * | 4/1999 | ..... F01L/9/04 |
| DE | 198 24 475 | 12/1999 | |
| DE | 199 47 848 | 5/2000 | |
| EP | 279 265 | 8/1988 | |
| FR | 931 101 | 2/1948 | |

* cited by examiner

*Primary Examiner*—Noah P. Kamen
(74) *Attorney, Agent, or Firm*—Kenyon & Kenyon

(57) ABSTRACT

A connection between two shaft ends situated coaxially one behind the other, of a gas exchange valve of an internal combustion engine and a piston rod of a valve actuator is provided, where at least one coupling member at least partially surrounds the shaft ends. The coupling member is radially compressed with respect to the two shaft ends by at least one compressing member to produce static friction locking between each shaft end and the coupling member that transfers the actuating motion of valve actuator to gas exchange valve in a slip-free manner. As a result, the fatigue strength of the connection may be increased and its assembly and disassembly may be simplified.

8 Claims, 2 Drawing Sheets

CONNECTION BETWEEN TWO SHAFT ENDS, POSITIONED COAXIALLY ONE BEHIND THE OTHER, OF A GAS SHUTTLE VALVE IN AN INTERNAL COMBUSTION ENGINE AND A VALVE ACTUATOR

FIELD OF THE INVENTION

The present invention relates to a connection between two shaft ends situated coaxially one behind the other of a gas exchange valve of an internal combustion engine and of a valve actuator, where at least one coupling member at least partially surrounds the shaft ends.

BACKGROUND INFORMATION

A connection is known from published patent document EP 0 279 265 B1, where the coupling member includes two half-shells whose radially external peripheral surfaces are cylindrical, and whose radially internal peripheral surfaces are conical in a manner complimentary to the piston rod ends of the valve actuator, which are tapered conically with respect to one another, and to a shaft of the gas exchange valve. To prevent the two half-shells from falling apart, a cylindrical coupling sleeve is held to the half-shells by the axial prestress force of a valve spring which is supported on the bottom of the screw sleeve and is pushed over them, and the shaft of the gas exchange valve extends through an opening in the bottom of the screw sleeve. The two shaft ends, which are tapered relative to each other, have at the extremity flanges that are widened in a plate-like manner and grip the coupling member formed by the half-shells from behind, so that the two shaft ends are connected to one another by the coupling member in a form-locking manner. At the form-locking junction between the conical runout of the shaft ends and the extreme flanges, the cross-section is weakened in each case by a distinct groove, which has a negative effect on the fatigue strength of the connection. This represents a significant disadvantage especially with regard to the high number of load changes that gas exchange valves of internal combustion engines are subjected to.

SUMMARY OF THE INVENTION

Due to the frictionally engaged connection between the coupling member and the shaft ends, no undercuts are necessary such as groove-like indentations which weaken the cross-section of the shaft ends and/or of the coupling member. Consequently, the connection of the present invention is distinguished by a high degree of fatigue strength.

According to an exemplary embodiment, the prestress applied to the coupling member by the compressing member may be adjustable. For this purpose, the compressing member includes at least two conical compressing sleeves which may be axially screwed against one another and have conical surfaces that may be wedged against conical compressing surfaces formed on the radially external peripheral surface of the coupling member. A defined radial prestress may be generated between the coupling member and the shaft ends as a function of the degree of tightening of the conical compressing sleeves. This may be advantageous with regard to the surface conditions that may differ depending on the gas exchange valve or the valve actuator and to the correspondingly different friction coefficient in that the radial prestress necessary for slip-free static friction locking may be adjusted.

Viewed in the circumferential direction, the coupling member has a multi-part design and preferably includes at least two half pipe-shaped coupling wedges, which complement one another to form a sleeve. Each coupling wedge has on its outer peripheral surface two compressing surfaces situated radially one behind the another and expanding conically with respect to one another, and each compressing surface may be assigned to one conical surface of one of the conical compressing sleeves. Both conical compressing sleeves may be expediently provided with a contact surface for a screw tool.

According to a further embodiment, positioning projections and positioning recesses that preferably intermesh with play may be provided on the coupling member and on each shaft end for positioning the coupling member on the shaft ends. This ensures that the coupling member may be compressed in a defined position with respect to the shaft ends, and may result in a balanced surface covering. On the other hand, the loose intermeshing of the positioning projections and recesses, reduces fatigue strength-lowering notch stresses. According to an exemplary embodiment, the radially internal, cylindrical peripheral surface of the coupling wedges has annular protuberances that extend in the circumferential direction, and each annular protuberance may be assigned to an annular groove of a shaft end. The annular protuberances and annular grooves have an essentially semicircular cross section, the inner radius of the annular grooves being greater than the outer radius of the annular protuberance in order to prevent direct material contact as much as possible, and to keep the notch stresses caused by the annular grooves as low as possible.

Finally, the connection between the valve actuator and the gas exchange valve may be situated in an accessible region outside of a valve actuator housing. Therefore, in the event that repairs may be needed, it may be very easy to replace a gas exchange valve or a valve actuator, and it may not be necessary to dismantle the valve actuator.

DETAILED DESCRIPTION

Figure 1:
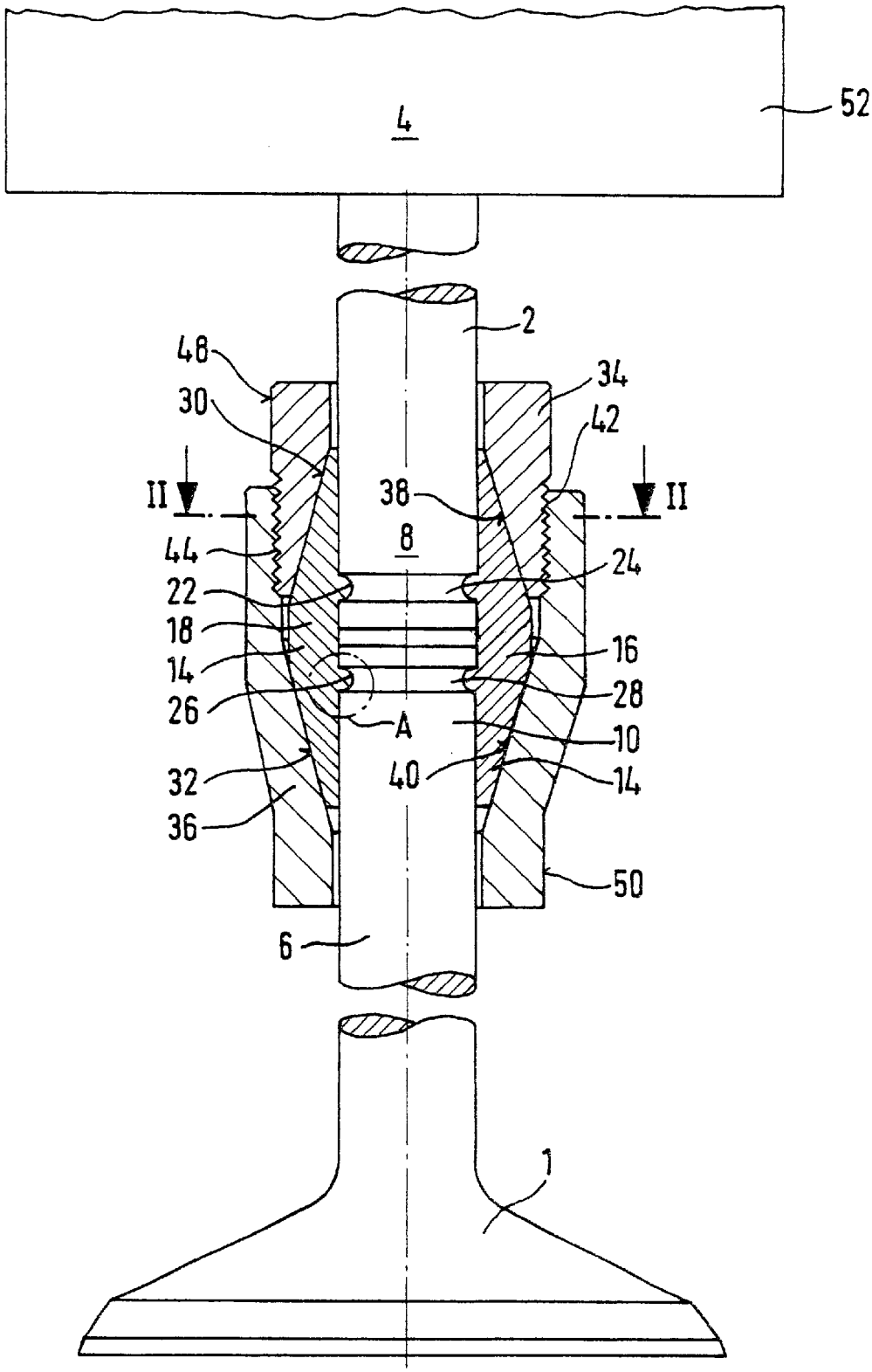
FIG. 1 shows a lateral view of a cross-section of a preferred specific embodiment of a connection of the invention between a shaft end of a gas exchange valve of an internal combustion engine, and a piston rod of a valve actuator.
Figure 2:
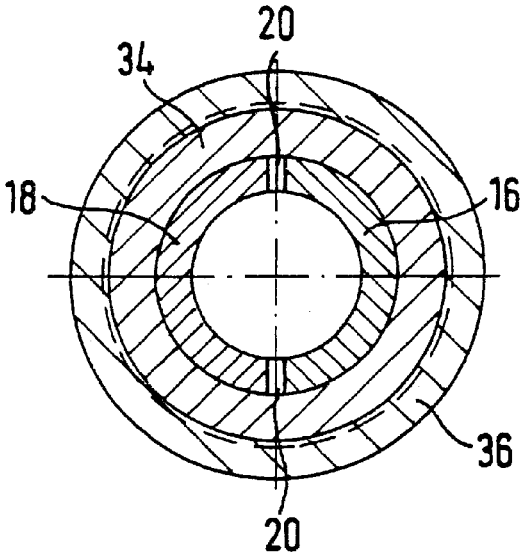
FIG. 2 shows a view of a cross-section along line II—II from FIG. 1.

Only a gas exchange valve 1 of a valve mechanism of an internal combustion engine is shown in FIG. 1. The gas exchange valve 1 is actuated by a piston rod 2 of a valve actuator 4 such that it performs upward and downward opening and closing movements. For this purpose, piston rod 2 of valve actuator 4 and a shaft 6 of gas exchange valve 1 may be situated coaxially one behind the other, and a shaft end 8 of piston rod 2, and a shaft end 10 of shaft 6 of gas exchange valve 1, may be situated opposite one another. Piston rod 2 and shaft 6 of gas exchange valve 1 preferably have the same diameter. To be able to transfer the pressing motion and/or pulling motion of piston rod 2 to gas exchange valve 1, a coupling member 14 is provided that at least partially surrounds shaft end 8 of piston rod 2 as well as shaft end 10 of gas exchange valve 1. Viewed in the circumferential direction, coupling body 14 preferably has a multi-part design and includes two half pipe-shaped coupling wedges 16, 18, which complement one another to essentially form a sleeve, as is best seen in the sectional view in FIG. 2. The radially internal peripheral surfaces of both coupling wedges 16, 18 may be cylindrical and may have the same radius as piston rod 2 and shaft 6 of gas exchange valve 1. Viewed in the circumferential direction, both coupling wedges 16, 18 do not connect to one another without gap, but a narrow opening 20 remains at both joints, so that there may be a circumferential compensation for both coupling wedges 16, 18 when a radial pressure may be exerted on them from the outside.

Figure 3:
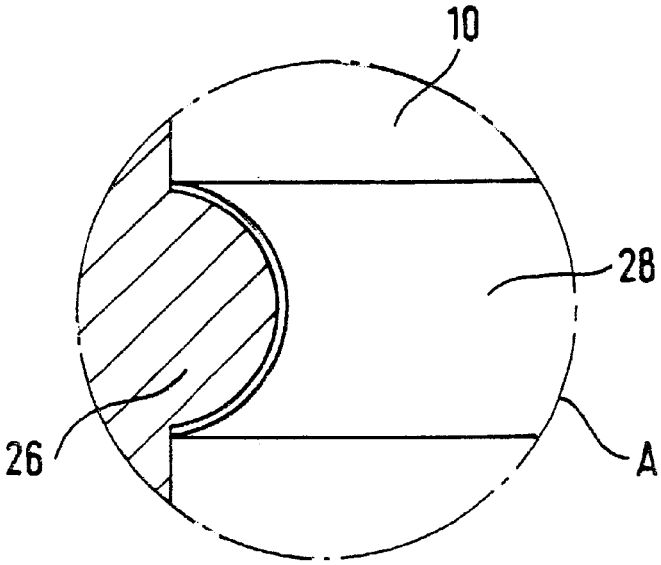
FIG. 3 shows an enlarged view of detail A from FIG. 1.

As can best be seen in FIG. 1, intermeshing positioning projections and positioning recesses may be provided on coupling member 14 and on each shaft end 8, 10 for positioning coupling member 14 on shaft ends 8, 10. This ensures that coupling member 14 may be situated in a defined position with respect to both shaft ends 8, 10 and that results in a balanced surface covering. According to the preferred specific embodiment, each radially internal, cylindrical peripheral surface of both coupling wedges 14, 16 has two annular protuberances extending in the circumferential direction, a top annular protuberance 22 engaging with a circumferential annular groove 24 formed on shaft end 8 of piston rod 2, and a bottom annular protuberance 26 engaging with an annular groove 28 in a shaft end 10 of gas exchange valve 1. Annular protuberances 22, 26 and annular grooves 24, 28, which may be assigned to one another, have an essentially semicircular cross section as can be seen, particularly, in enlarged view A in FIG. 3. Annular protuberances 22, 26 do not abut against annular grooves 24, 28 of the shaft ends since their inner radius is greater than the outer radius of annular protuberances 22, 26.

Both half pipe-shaped coupling wedges 16, 18 have on their radially external peripheral surface compressing surfaces 30, 32 disposed one behind the other and expanding conically toward one another in order to be able to compress couple wedges 16, 18 radially with respect to both shaft ends 8, 10. For this purpose, a compressing member, preferably two conical compressing sleeves 34, 36, which may be axially screwed against each other and have conical surfaces 38, 40, may be provided that may be wedged against compressing surfaces 30, 32 of coupling wedge 16, 18. A defined radial prestress may be produced between coupling wedges 16, 18 and both shaft ends 8, 10 as a function of the screwing degree of the two conical compressing sleeves 34, 36. Since the motion of piston rod 2 of valve actuator 4 may be transferred to gas exchange valve 1 in a slip-free manner, the prestress must be so great that there may always be static friction between coupling wedges 16, 18 and shaft ends 8, 10 under the forces acting during operation. Of the two compressing surfaces 30, 32 of a coupling wedge 16, 18, a top compressing surface 30 may be assigned in each case to a conical surface 38 of top conical compressing sleeve 34, and a bottom compressing surface 32 may be assigned in each case to a conical surface 40 of bottom conical compressing sleeve 36. Top conical compressing sleeve 34 may be screwed into bottom conical compressing sleeve 36 because radially external peripheral surface of top conical compressing sleeve 34 may be provided with an external thread 42, and the radially internal peripheral surface of bottom conical compressing sleeve 36 may be provided with an internal thread 44 having the same diameter. Both conical compressing sleeves 34, 36 may be provided at their ends facing away from one another with a contact surface 48, 50 for a screw tool. Threads 42, 44 may be consequently outside of the force flux that arises when the valve may be actuated and extends from piston rod 2 over the two coupling wedges 16, 18 to shaft 6 of gas exchange valve 1 and may only be subjected to the static prestress for procuring the friction locking between coupling wedges 16, 18 and shaft ends 8, 10. Since annular protuberances 22, 26 of both coupling wedges 16, 18 do not rest against annular grooves 24, 28 of shaft ends 8, 10, the form locking portion generated by coupling wedges 16, 18 being radially pressed outweighs the form locking portion caused by the mutually assigned annular protuberance/annular groove pairings in the case of the coupling of piston rod 2 and shaft 6 of gas exchange valve 1. Consequently, the annular protuberance/annular groove pairings may be foremost used to fix the coupling member 14 to shaft ends 8, 10 and may, therefore, have small dimensions. Consequently, their stress concentration at shaft ends 8, 10 and their influence on the fatigue strength of the connection may be minimal.

As seen in FIG. 1, the described connection between piston rod 2 of valve actuator 4 and shaft 6 of the gas exchange valve may be situated outside of a valve actuator housing 52 of valve actuator 4 in an easily accessible region, so that valve actuator 4 and gas exchange valve 1 may be both easy to assemble and disassemble as individual modules.

According to a further specific embodiment, coupling member 14 may also be designed as a one-piece sleeve instead of as a two-piece sleeve, where a continuous slit extends in the axial direction and needs to be provided, in this case, in the wall of the sleeve, in order to enable compensating motion of the one-piece sleeve in the circumferential direction when radial prestress may be applied from the outside by the wedge effect of conical compressing sleeves 34, 36.

What is claimed is:

1. A connection between two adjacent coaxial shaft ends of a gas exchange valve of an internal combustion engine and a piston rod of a valve actuator, comprising:

at least one coupling member which at least partially surrounds the shaft end of the gas exchange valve and the shaft end of the piston rod; and at least one compressing member, wherein the coupling member is radially compressed with respect to the two shaft ends by the at least one compressing member to produce a static friction lock between each shaft end and the coupling member, whereby an actuating motion of the valve actuator to the gas exchange valve is transferred in a slip-free manner.

2. The connection as recited in claim 1, wherein the compressing member comprises at least two conical compressing sleeves which are adapted to be axially screwed against one another, wherein the sleeves have conical surfaces which are adapted to be wedged against conical compressing surfaces formed on radially external peripheral surface of the coupling member, to generate a radial prestress which produces a static friction lock between the coupling member and the shaft ends.

3. The connection as recited in claim 2, wherein the conical compressing sleeves have a contact surface for a screw tool.

4. The connection as recited in claim 2, wherein the coupling member comprises at least two half pipe-shaped coupling wedges adapted to form a sleeve and each having on its radially external peripheral surface two compressing surfaces situated one behind the other and expanding conically toward one another, and wherein each compressing surface mates with a corresponding conical surface of one of the conical compressing sleeves.

5. The connection as recited in claim 4, wherein the coupling wedges have on their radially internal, cylindrical peripheral surface at least two annular protuberances which extend in the circumferential direction, and wherein at least one annular protuberance is adapted to mate with a corresponding annular groove on a shaft end.

6. The connection as recited in claim 5, wherein the annular protuberances and annular grooves have an essentially semicircular cross-section, and wherein the inner radius of the annular grooves is greater than the outer radius of the annular protuberances.

7. The connection as recited in claim 1, wherein the connection is situated in an accessible region outside of a valve actuator housing.

8. The connection as recited in claim 1, further comprising positioning projections and positioning recesses provided on the coupling member and each shaft end for positioning the coupling member with respect to the shaft ends.

* * * * *